US006677841B2

(12) United States Patent
Passow

(10) Patent No.: US 6,677,841 B2
(45) Date of Patent: Jan. 13, 2004

(54) SYSTEM AND METHOD FOR MOUNTING A PUSHER AND MOVEABLE CONTACT IN A CONTACT BLOCK

(75) Inventor: Christian H. Passow, Ann Arbor, MI (US)

(73) Assignee: Siemens Energy & Automation, Alpharetta, GA (US)

( * ) Notice: Subject to any disclaimer, the term of this patent is extended or adjusted under 35 U.S.C. 154(b) by 63 days.

(21) Appl. No.: 09/961,162

(22) Filed: Sep. 21, 2001

(65) Prior Publication Data

US 2003/0057079 A1 Mar. 27, 2003

(51) Int. Cl.[7] ..... H01H 67/02
(52) U.S. Cl. ..... 335/132; 335/202
(58) Field of Search ..... 335/132, 202, 335/167–176; 200/243, 247

(56) References Cited

U.S. PATENT DOCUMENTS 4,578,549 A * 3/1986 Grunst et al. ..... 200/76
5,500,630 A * 3/1996 Edwards, Jr. et al. ..... 335/132
5,758,762 A * 6/1998 Aulmann ..... 200/331

* cited by examiner

*Primary Examiner*—Lincoln Donovan

(57) ABSTRACT

A contact assembly for use in an electrical apparatus comprises a housing and a pusher movably mounted in the housing. A movable contact is supported on the pusher. A stationary contact is proximate the moveable contact in the housing. A return spring biases the pusher to a normal position. A contact spring operatively associated with the moveable contact forces the movable contact against a stop associated with the pusher. The contact spring and the return spring are of identical construction and are positioned in the housing so that force or torque produced by the return spring is greater than force or torque produced by the contact spring.

19 Claims, 4 Drawing Sheets

SYSTEM AND METHOD FOR MOUNTING A PUSHER AND MOVEABLE CONTACT IN A CONTACT BLOCK

CROSS-REFERENCE TO RELATED PATENT APPLICATIONS

The present U.S. patent application having at least one common inventor as

- U.S. patent application Ser. No. 09/961,155 entitled "System and Method for Auxiliary Contact Assembly", and
- U.S. patent application Ser. No. 09/961,159 entitled "System and Method for Auxiliary Contact Assembly and Snap Mounting", and
- U.S. patent application Ser. No. 09/961,156 entitled "System and Method for Mounting a Moveable Contact in a Contact Block, and
- U.S. patent application Ser. No. 09/961,158 entitled "Contact Block Assembly and Method of Assembling a Contact Block Assembly", and
- U.S. patent application Ser. No. 09/961,161 entitled "Pusher Assembly and Method of Assembling a Pusher Assembly,
- U.S. patent application Ser. No. 09/961,160 entitled "Movable Contact and a Method of Assembling a Pusher Assembly having a Movable Contact" are filed with the U.S. patent and Trademark Office concurrently on Sep. 21, 2001, the entirety of each being incorporated herein by reference.

TECHNICAL FIELD OF THE INVENTION

This invention relates to a contact assembly for use in an electrical switching apparatus designed to reduce the number of different parts required.

BACKGROUND OF THE INVENTION

A conventional electrical switching apparatus in one known form typically comprises an electromagnetically actuable device having a magnetic core proximate an armature. Typically, a coil is electrically energized to draw the armature to the magnetic core. The electromagnetically actuated device may be a control relay, a contactor, a motor starter or the like. The armature is operatively associated with a movable device such as an actuator. With an electrical switching apparatus the actuator operates a contact assembly.

A contact assembly may be an integral component of the electrical switching apparatus or it may an auxiliary device to be added thereto. In either case, a housing typically supports an electrical contact and a pusher. The pusher is selectively actuated to operate the electrical contact. A typical electrical contact includes one or two stationary contacts mounted in the housing and a moveable contact mounted on the pusher.

In applications involving the making of an electrical contact by moving a moveable contact against a pair of stationary contacts, the moveable contact is typically mounted on the pusher and forced against a stop on the pusher by a contact spring.

In a normally closed contact, the pusher is typically held by the return spring with the movable contact touching the stationary contacts. To avoid arcing when the contact closes, the moveable contact is typically held against the stationary contacts by a contact spring which, in turn, is compressed by the pusher. When the pusher is forced by an external actuator away from the stationary contacts, then the return spring is compressed and the contact spring extends until the moveable contact hits its stop on the pusher and lifts off of the stationary contacts.

In a normally open contact, the pusher is typically held with the moveable contact off of the stationary contacts by a return spring. When the pusher is forced by an external actuator towards the stationary contacts, then the moveable contact touches the stationary contacts and is held against the stationary contacts by the force of a contact spring. Alternatively, the contact spring can be mounted to a housing and a return spring holds the pusher against the moveable contact in such a way that it holds the moveable contact off of the stationary contacts until the pusher is forced by an external actuator away from the stationary contacts, thus allowing the moveable contact to come to rest against the stationary contacts under the force of the contact spring.

In both the typical normally closed configuration and alternative normally open configuration, discussed above, the force or torque applied by the return spring on the pusher must be greater than the force or torque applied by contact spring on the pusher. Otherwise, in the typical normally closed configuration, the contact spring would not compress and there might be problems with arcing. In the alternative normally open configuration the contact spring would force the contact closed, even if no external force is applied. Thus, contact assemblies designed for these typical configurations use different spring designs for the contact spring and the return spring, requiring inventory of different parts and loss of economies of scale.

Accordingly, there is a need for a contact assembly for use in an electrical switching apparatus designed to reduce the number of different parts required.

SUMMARY OF THE INVENTION

In accordance with the invention there is provided a contact assembly for use in an electrical switching apparatus designed to reduce the number of different parts required.

Broadly, there is disclosed a contact assembly for use in an electrical apparatus comprising a housing and a pusher movably mounted in the housing. A movable contact is supported on the pusher. A stationary contact is provided in the housing proximate the moveable contact. A pair of identical springs are mounted in the housing. Means are provided for mounting one of the springs as a return spring biasing the pusher to a normal position and the other of the springs as a contact spring operatively associated with the moveable contact to force the movable contact against a stop associated with the pusher, so that force or torque produced by the return spring is greater than force or torque produced by the contact spring.

In accordance with one aspect of the invention the contact assembly provides a normally open contact configuration. The contact spring extends between a stop on the housing and the moveable contact.

In accordance with another aspect of the invention the contact assembly provides a normally closed contact configuration. The movable contact is mounted on a post extending from the pusher and the contact spring extends between the pusher and the moveable contact.

In accordance with a further aspect of the invention the pusher is movably mounted in the housing for linear movement and spacing between the housing and the pusher at the return spring is less than spacing between the housing and the moveable contact at the contact spring.

In accordance with still another aspect of the invention the pusher is movably mounted in the housing for rotary movement and spacing between a pivot point and the pusher at the return spring is greater than spacing between the pivot point and the pusher at the contact spring.

In accordance with yet another aspect of the invention a contact assembly for use in an electrical apparatus comprises a housing and a pusher movably mounted in the housing. A movable contact is supported on the pusher. A stationary contact in the housing is proximate the moveable contact. A return spring biases the pusher to a normal position. A contact spring operatively associated with the moveable contact forces the movable contact against a stop associated with the pusher. The contact spring and the return spring are of identical construction and are positioned in the housing so that force or torque produced by the return spring is greater than force or torque produced by the contact spring.

Further features and advantages of the invention will be readily apparent from the specification and from the drawings.

DETAILED DESCRIPTION OF THE INVENTION

Figure 1:
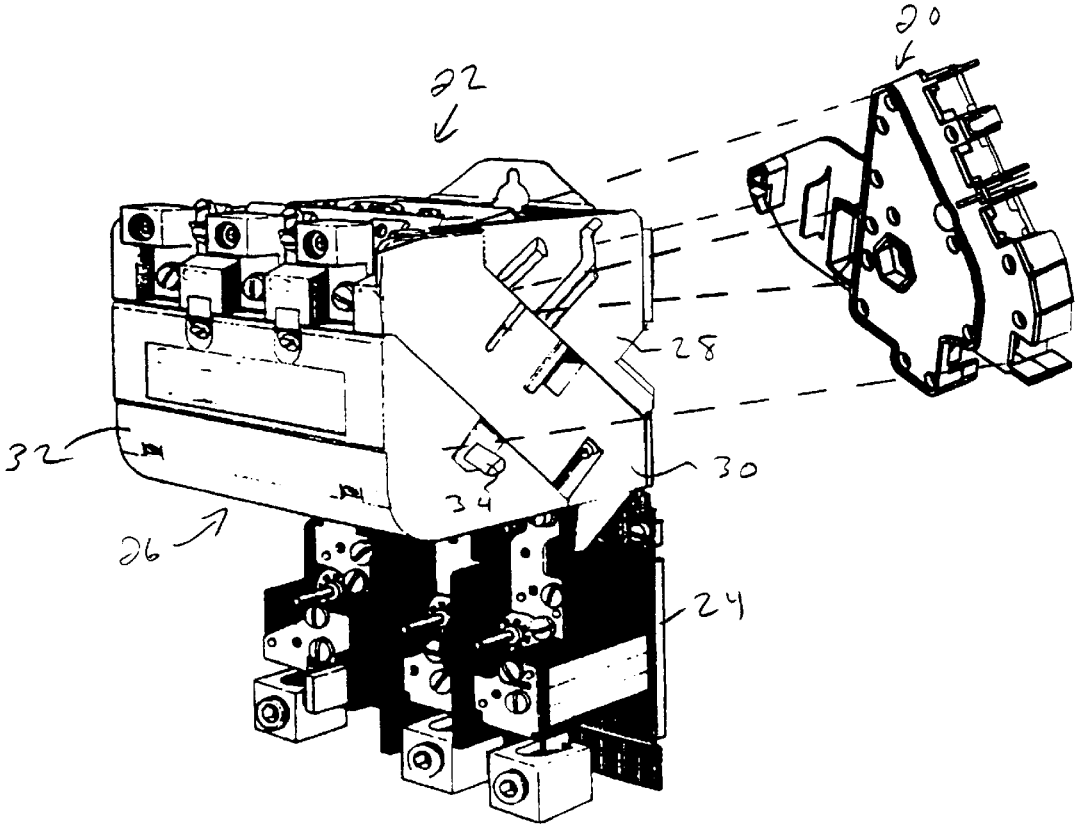
FIG. 1 is a perspective view illustrating a contact assembly used with an electrical switching apparatus in accordance with the invention.

Referring to FIG. 1, a contact assembly in the form of an auxiliary contact block 20 for use with an electrical switching apparatus in the form of an electrical contactor 22 is illustrated. The present invention relates to a contact assembly designed to reduce the number of different parts required.

The contactor 22 is an electromagnetically actuable device and includes a mounting plate 24 for mounting in a control panel or the like. A main housing 26 is mounted to the mounting plate 24. The main housing 26 includes a base 28, a switch housing 30 and a cover 32. Although not specifically illustrated herein, the main housing 26 encloses an electrical coil associated with a magnetic core and armature for driving an actuator having opposite ends 34, one of which is shown in FIG. 1. Additionally, the main housing 26 encloses various electrical contacts which can be opened or closed responsive to energization of the coil. The actuator ends 34 extend outwardly of opposite sides of the main housing 26. As a result, the auxiliary contact block 20 can be mounted to either side of the main housing 26.

Figure 2:
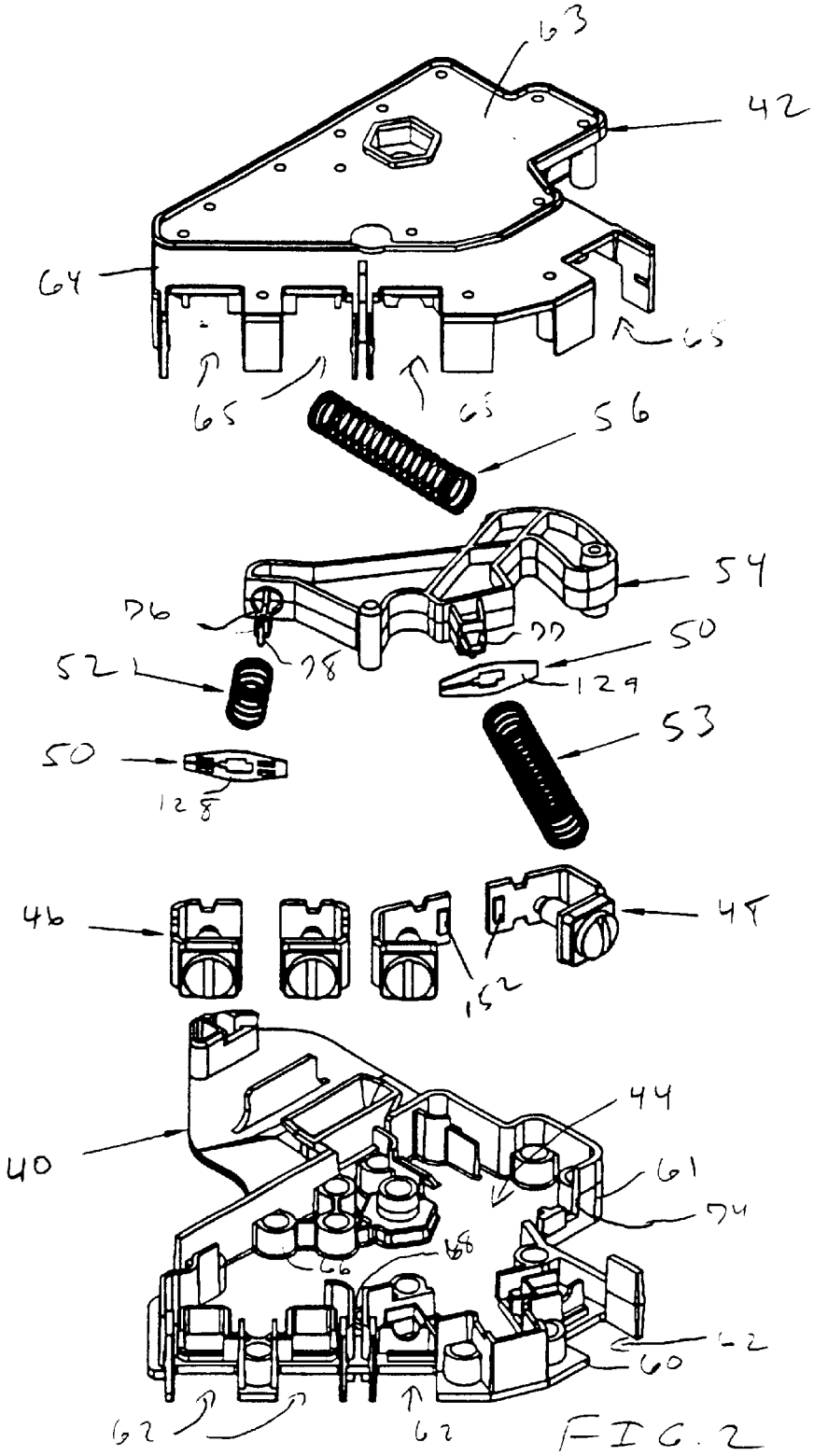
FIG. 2 is an exploded view of the contact assembly of FIG. 1.
Figure 3:
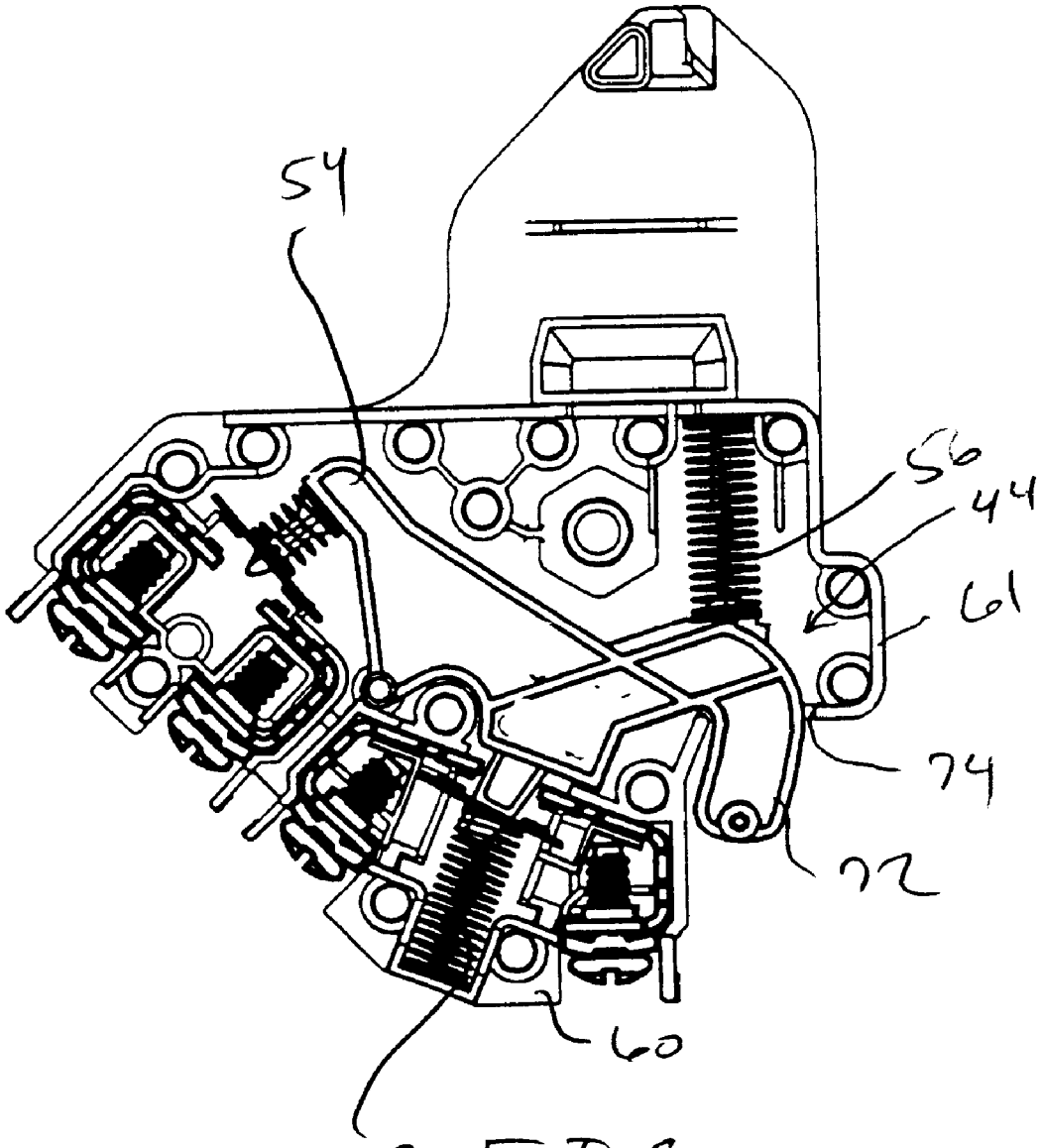
FIG. 3 is a plan view of the contact assembly of FIG. 2 with a cover removed.

Referring to FIGS. 2 and 3, the auxiliary contact block 20 includes a housing 40 and a cover 42 to define an interior space 44. Both the housing 40 and cover 42 are of one-piece molded plastic. Mounted in the interior space 44 are a first pair of stationary normally open contacts 46, a second pair of stationary normally open contacts 48, two movable contacts 50, a first contact spring 52, a second contact spring 53, a pusher 54 and a return spring 56.

The housing 40 includes a generally planar outer wall 60 connected to an upwardly turned side wall 61. The side wall 61 extends generally around the perimeter of the outer wall 60 except for terminal openings 62. The cover 42 includes a generally planar outer wall 63 connected to a downwardly turned partial side wall 64. The side wall 64 extends generally around a portion of the perimeter of the outer wall 63 and provides terminal openings 65. Particularly, the cover outer wall 63 is virtually a mirror image of the housing outer wall 60. The cover side wall 64 and housing side wall 61 provide a perimeter wall around the interior space 44 with the openings 62 and 65 in the same positions to provide external access to the stationary contacts 46 and 48. A plurality of collars 66 extend upwardly from the housing outer wall 60. The collars 66 receive posts (not shown) extending downwardly from the cover outer wall 63 to retain the cover 42 on the housing 40.

An annular ring 68 on the housing outer wall 60, and a similar annular ring (not shown) on the cover outer wall 63, receive a pivot post 70 of the pusher 54 to pivotally mount the pusher 54 in the interior space 44. The pusher 54 is of one piece molded plastic and includes an elongate base 71 that includes an arm 72 at one end that extends outwardly of an opening 74 in the housing side wall 61, as particularly illustrated in FIG. 3. The pusher 54 also includes a first post 76 and a second post 77 extending upwardly from the base 71 on opposite sides of the pivot post 70. The first post 76 is adapted to support the contact spring 52 and one of the movable contacts 50 Particularly, a head 78 on the first post 76 acts as a fulcrum for the moveable contact 50. The second post 76 is adapted to support the other one of the movable contacts 50 which is held in place by the second contact spring 53. Particularly, the second contact spring 53 is compressed between the side wall 61 and the moveable contact 50 so that it pushes the moveable contact 50 onto the second post 77.

The stationary contacts 46 and 48 are mounted in the housing 40 as illustrated in FIG. 3. With the pusher 54 pivotally mounted in the housing 40, each of the movable contacts 50 is positioned in proximity to one of the stationary contact pairs 46 or 48. In the illustrated embodiment of the invention, both of the movable contacts 50 provide a normally open contact arrangement relative to the stationary contacts 46 and 48. Other contact relationships may also be used. Also, only a single contact may be included. The return spring 56 biases the pusher 54 into a normal position. The stationary contacts 46 and 48, the second contact spring 53, the pusher 54 and the return spring 56 are loosely held in the interior space 44 captured between the cover 42 and the housing 40.

In operation, depressing the pusher arm 72 against the return spring 56 causes the state of the movable contacts 50 relative to the contact pairs 46 or 48 to change from open to close. Releasing the arm 72 causes the pusher 54 to return to the normal position under the force of the return spring 56. The contact springs 52 and 53 maintain a bias on the movable contacts 50 so they selectively maintain desired contact with the stationary contacts 46 or 48.

The housing 40, cover 42, movable contacts 50, stationary contacts 46 and 48 and contact springs 52 and 53 can be used to create a variety of switching arrangements with different make and break configurations and timing by varying the geometry of the pusher 54 and the point about which the pusher 54 pivots.

In accordance with the invention, the second contact spring 53 is identical to the return spring 56. Particularly, the return spring 56 is mounted further from the pivot of the pusher 54, represented by the pivot post 70, than is the second contact spring 53. As a result, the torque applied to the pusher 54 by the return spring 56 is greater than the torque applied to the pusher 54 by the second contact spring 53. This is true even though the force applied by the return spring 56 and the second contact spring 53 is roughly the same.

In the illustrated embodiment of the invention, both the return spring 56 and the second contact spring 53 have the following specifications:

| | |
|---|---|
| Wire material | 302 Stainless Steel |
| Torsional modulus of elasticity (G) | $10 \times 10^6$ PSI |
| Wire diameter | .016 in. |
| Inside diameter | .203 in. |
| Outside diameter | .235 in. |
| Total turns (Nt) | 22 |
| Active turns (Na) | 16 |
| Free length (L) | 1.1 in. |
| Spring rate | .49 lb./in. |
| Final working length | .505 in. |

As will be appreciated by those skilled in the art, springs satisfying different specifications from those set forth in the example above could also be used.

Figure 4:
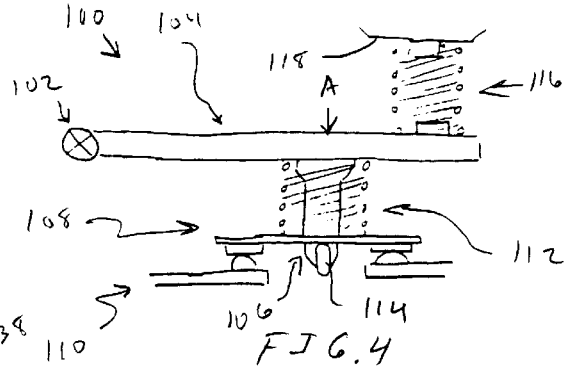
FIG. 4 is side view of a normally closed contact assembly in accordance with the invention using rotary operation.

Referring to FIG. 4, a normally closed contact assembly 100 in accordance with an alternative embodiment of the invention also uses rotary operation. The contact assembly 100 is also mounted in a housing (not shown) which could be similar to the housing 40 of FIG. 2 and has a pivot 102. A pusher 104 is pivotally mounted to the pivot 102. A post 106, similar to the post 76 above, carries a moveable contact 108. The housing also supports a pair of stationary contacts 110. A contact spring 112 is received on the post 106 and forces the moveable contact 108 against a head 114 of the post 106. A return spring 116 extends between the pusher 104 and a stop 118 of the housing.

The return spring 116 and the contact spring 112 are identical. However, the spacing between the pivot 102 and the contact point of the return spring 116 is greater than the spacing between the pivot 102 and the post 106. As a result, the torque of the return spring 116 is greater than torque of the contact spring 112.

Alternatively, the return spring could be moved to the point marked A on the pusher 104 so that it is coaxial with the contact spring 112. In this example, the spacing between the stop 118 and the pusher 104 is less than the spacing between the pusher 104 and the moveable contact 108. As a result, the return spring 116 is compressed to a greater extent than the contact spring 112 so that torque produced by the return spring 116 is greater.

Figure 5:
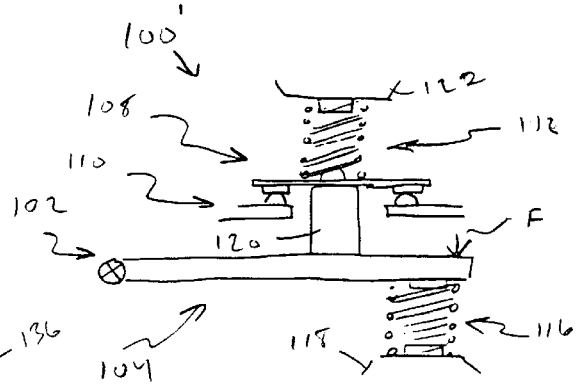
FIG. 5 is side view of a normally open contact assembly in accordance with the invention using rotary operation.

FIG. 5 illustrates a normally open contact assembly 100' in accordance with an alternative embodiment of the invention also using rotary operation. Like reference numerals are used relative to the example of FIG. 4 to identify like elements. In this example, the movable contact 108 is supported on a post 120, similar to the post 77 discussed above. The contact spring 112 extends between another housing stop 122 and the moveable contact 108. Thus, the contact spring 112 pushes the movable contact 108 against the pusher post 120. In the illustration, a force F is shown that closes the normally open contact. As with the embodiment of FIG. 4, the return spring 116 is either mounted further from the pivot than the contact spring 112, as shown, or is compressed greater than the contact spring 112 in the normal state.

Figure 6:
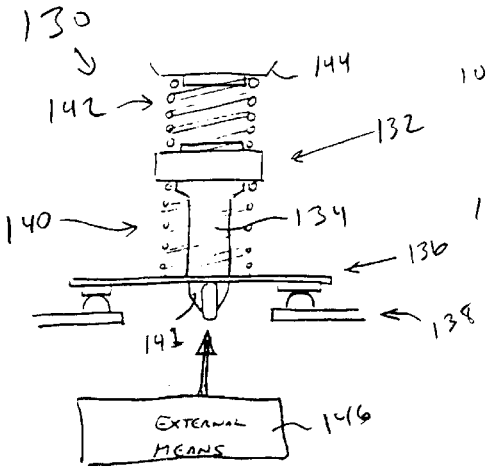
FIG. 6 is side view of a normally closed contact assembly in accordance with the invention using linear operation.

Referring to FIG. 6, a normally closed contact assembly 130 in accordance with an alternative embodiment of the invention also uses linear operation. The contact assembly 130 is also mounted in a housing (not shown) which could be similar to the housing 40 of FIG. 2. A pusher 132 is mounted for linear movement in the housing by any known means. A post 134, similar to the post 76 above, carries a moveable contact 136. The housing also supports a pair of stationary contacts 138. A contact spring 140 is received on the post 134 and forces the moveable contact 136 against a head 141 of the post 134. A return spring 142 extends between the pusher 132 and a stop 144 of the housing.

The return spring 142 and the contact spring 140 are identical. However, the spacing between the stop 144 and the pusher 132 is less than the spacing between the pusher 132 and the moveable contact 136. As a result, the return spring 142 is compressed to a greater extent than the contact spring 140 so that force produced by the return spring 142 is greater than force produced by the contact spring 140. An external means 146, such as an actuator, is used to act on the pusher 132 to open the contact.

Figure 7:
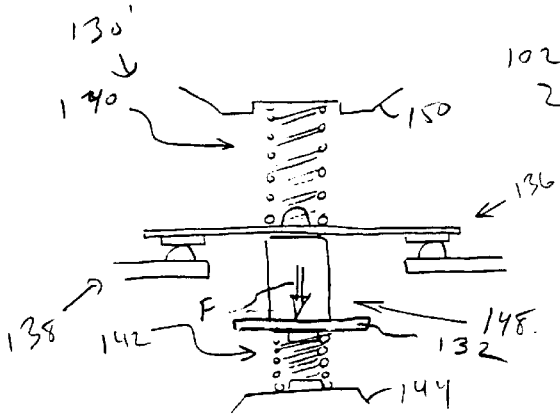
FIG. 7 is side view of a normally open contact assembly in accordance with the invention using linear operation.

FIG. 7 illustrates a normally open contact assembly 130' in accordance with an alternative embodiment of the invention also using linear operation. Like reference numerals are used relative to the example of FIG. 6 to identify like elements. In this example, the movable contact 136 is supported on a post 148, similar to the post 77 discussed above, on the pusher 132. The contact spring 140 extends between another housing stop 150 and the moveable contact 136. Thus, the contact spring 140 pushes the movable contact 136 against the pusher post 148. In the illustration, a force F is shown acting on the pusher 132 that closes the normally open contact. As with the embodiment of FIG. 6, the spacing between the stop 144 and the pusher 132 is less than the spacing between the stop 150 and the moveable contact 136. As a result, the return spring 142 is compressed to a greater extent than the contact spring 140 so that force produced by the return spring 142 is greater than force produced by the contact spring 140.

It can therefore be appreciated that a new and novel system and method for mounting a pusher and moveable contact in a contact block has been described. It will be appreciated by those skilled in the art that, given the teaching herein, numerous alternatives and equivalents will be seen to exist which incorporate the disclosed invention. As a result, the invention is not to be limited by the foregoing exemplary embodiments, but only by the following claims.

I claim:

1. A contact assembly for use in an electrical apparatus comprising:

a housing;

a pusher movably mounted in the housing;

a movable contact supported on the pusher;

a stationary contact in the housing proximate the moveable contact;

a pair of identical springs mounted in the housing; and means for mounting one of the springs as a return spring biasing the pusher to a normal position and the other of the springs as a contact spring operatively associated with the moveable contact to force the movable contact against a stop associated with the pusher, so that force or torque produced by the return spring is greater than force or torque produced by the contact spring.

2. The contact assembly of claim 1 wherein the pusher provides a normally open contact configuration.

3. The contact assembly of claim 1 wherein the pusher provides a normally closed contact configuration.

4. The contact assembly of claim 1 wherein the pusher is movably mounted in the housing for linear movement and spacing between the housing and the pusher at the return spring is less than spacing between the housing and the moveable contact at the contact spring.

5. The contact assembly of claim 1 wherein the pusher is movably mounted in the housing for rotary movement and spacing between a pivot point and the pusher at the return spring is greater than spacing between the pivot point and the pusher at the contact spring.

6. A contact assembly for use in an electrical apparatus comprising:

a housing;

a pusher movably mounted in the housing;

a movable contact supported on the pusher;

a stationary contact in the housing proximate the moveable contact;

a return spring biasing the pusher to a normal position; and a contact spring operatively associated with the moveable contact to force the movable contact against a stop associated with the pusher, the contact spring and the return spring being of identical construction and being positioned in the housing so that force or torque produced by the return spring is greater than force or torque produced by the contact spring.

7. The contact assembly of claim 6 wherein the pusher provides a normally open contact configuration.

8. The contact assembly of claim 7 wherein the contact spring extends between a stop on the housing and the moveable contact.

9. The contact assembly of claim 6 wherein the pusher provides a normally closed contact configuration.

10. The contact assembly of claim 9 wherein the movable contact is mounted on a post extending from the pusher and the contact spring extends between the pusher and the moveable contact.

11. The contact assembly of claim 6 wherein the pusher is movably mounted in the housing for linear movement and spacing between the housing and the pusher at the return spring is less than spacing between the housing and the moveable contact at the contact spring.

12. The contact assembly of claim 6 wherein the pusher is movably mounted in the housing for rotary movement and spacing between a pivot point and the pusher at the return spring is greater than spacing between the pivot point and the pusher at the contact spring.

13. The method of assembling a contact assembly for use in an electrical apparatus comprising:

providing a housing;

mounting a pusher for movement in the housing, the pusher supporting a movable contact;

mounting a stationary contact in the housing proximate the moveable contact;

inserting a return spring in the housing biasing the pusher to a normal position; and inserting a contact spring so it is operatively associated with the moveable contact to force the movable contact against a stop associated with the pusher, the contact spring and the return spring being of identical construction and being positioned in the housing so that force or torque produced by the return spring is greater than force or torque produced by the contact spring.

14. The method of claim 13 wherein the pusher is mounted to provide a normally open contact configuration.

15. The method of claim 14 wherein the contact spring is inserted to extend between a stop on the housing and the moveable contact.

16. The method of claim 13 wherein the mounting the pusher comprises the pusher being mounted to provide a normally closed contact configuration.

17. The method of claim 16 wherein the movable contact is mounted on a post extending from the pusher and the contact spring extends between the pusher and the moveable contact.

18. The method of claim 13 wherein mounting the pusher comprises the pusher being movably mounted in the housing for linear movement and spacing between the housing and the pusher at the return spring is less than spacing between the housing and the moveable contact at the contact spring.

19. The method of claim 13 wherein mounting the pusher comprises the pusher being movably mounted in the housing for rotary movement and spacing between a pivot point and the pusher at the return spring is greater than spacing between the pivot point and the pusher at the contact spring.

* * * * *